US005977877A

United States Patent [19]

McCulloch et al.

[11] Patent Number: 5,977,877

[45] Date of Patent: Nov. 2, 1999

[54] MULTIPLE CONDUCTOR SECURITY TAG

[75] Inventors: Robert Donald McCulloch, Ottawa; David G. McEwing, Stittsville; Brian Wayne Martin, Nepean; Jennifer Ann Hartfield McKenzie, Ottawa, all of Canada

[73] Assignee: Instantel Inc., Kanata, Canada

[21] Appl. No.: 09/080,310

[22] Filed: May 18, 1998

[51] Int. Cl.[6] ..... G08B 13/187

[52] U.S. Cl. ..... 340/572.8; 340/572.9

[58] Field of Search ..... 340/572.8, 572.9

[56] References Cited

U.S. PATENT DOCUMENTS 5,512,879 4/1996 Stokes ..... 340/572.8

5,883,576 3/1999 De La Huerga ..... 340/572.9

*Primary Examiner*—Glen Swann

*Attorney, Agent, or Firm*—Pascal & Associates

[57] ABSTRACT

A security tag having a strap for securing the tag to an object to be protected and an electronic module connected to the strap for detecting an attempt to defeat the tag by short circuiting and severing the strap. The strap is formed of plural discrete conductors connected to the electronic module, which conductors are insulated from each other at least along a substantial length of the strap. Short circuiting of opposite ends of a single pair of the conductors followed by severance of plural ones of the insulated conductors, or short circuit in between separate conductors can be detected by the electronic module as an alarm condition. Severance or misconnection of only one or a small number of the insulated conductors can be detected by the electronic module as not being an alarm condition.

29 Claims, 3 Drawing Sheets

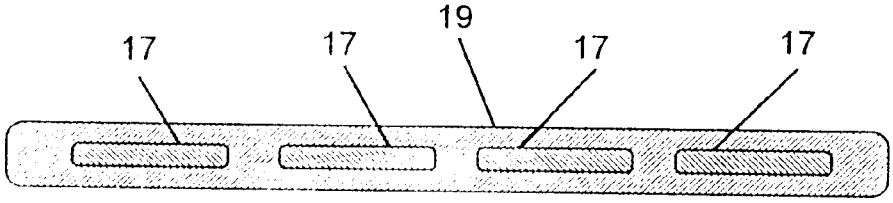
FIG. 4
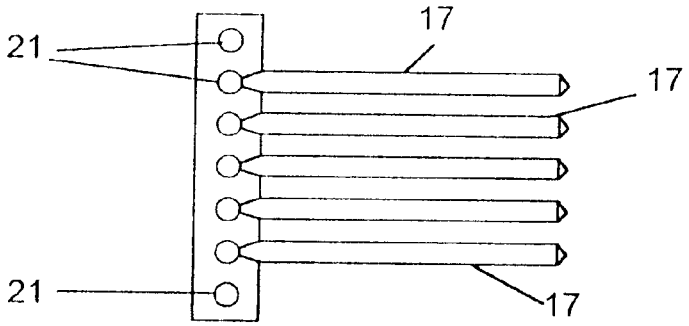
FIG. 5
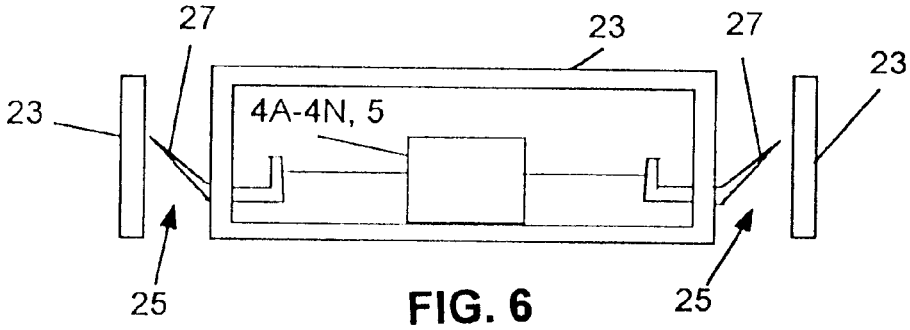
FIG. 6
FIG. 7A
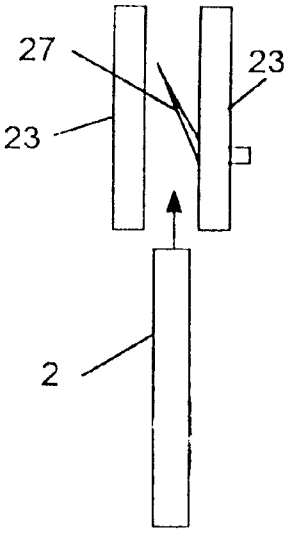
FIG. 7B
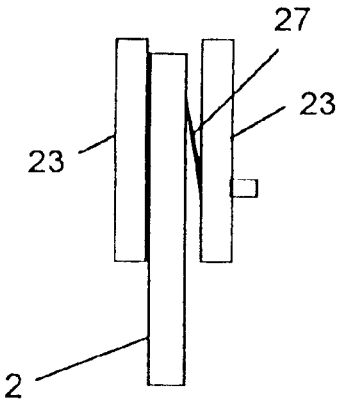
FIG. 7C
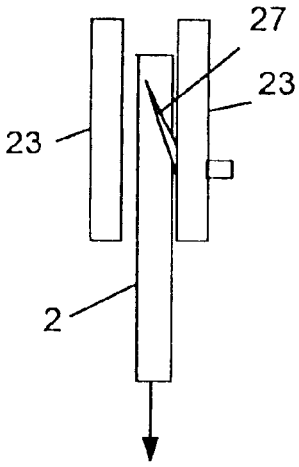

MULTIPLE CONDUCTOR SECURITY TAG

FIELD OF THE INVENTION

This invention relates to the field of asset protection and personal security, and in particular to an improved tag strap and connector structure.

BACKGROUND TO THE INVENTION

The location of assets and of persons can be determined by transponders or active transmitters attached to respective assets and persons. The transponder emits an identity signal which can be received by receivers located at various locations, such as adjacent doors, in rooms, halls, etc. The receivers typically report the received signals to a central computer which can draw a map or update a database and thereby display the locations of the assets and persons. Assets which do not report their location, or which are identified to be at an unauthorized location, can cause the central computer to set off an alarm.

The transponder is typically attached to an asset or to a person by means of a strap which contains a conductor. Persons wishing to defeat the transponder will sometimes sever the strap to release the transponder from the asset and try to make off with the asset. However, severance of the strap causes severance of the conductor, which can be detected by the transponder, and which can transmit an alarm signal. A person who understands that severance of the strap will raise an alarm will sometimes short circuit the strap conductor, and then cut the strap, in order to defeat the severance detection circuitry of the transponder.

In addition, sometimes wear and flexing of the strap will cause the conductor or the connection to the conductor to break, which will be interpreted by the severance detection circuitry of the transponder as an attempted theft and therefore it will raise an alarm, even though there is no real threat of theft of the asset or location of a person in an unauthorized location.

In addition, in order to connect the conductor in the strap to the transponder, they must be carefully assembled in order to ensure that solid connections are made to the ends of the conductor. This has been found to be costly and clumsy.

SUMMARY OF THE INVENTION

An embodiment of the present invention is a strap which substantially reduces the likelihood that a broken conductor or intermittent contact in the strap will trigger an alarm. Another embodiment of the invention is a connector which allows easy and inexpensive connection of the strap to a transponder, and in which connection tolerances and contact manufacturing tolerances are substantially relaxed from that of the above-described strap. Another embodiment of the invention is a security tag which has substantially less ability to be defeated by short circuiting a conductor of the strap.

As a result, a less expensive security tag can be made, with less likelihood of defeat by short circuiting, and with less likelihood of an alarms being set off due to unintended severance of a conductor or misconnection of a contact of the strap on purpose or due to wear or flexing of the strap.

In accordance with an embodiment of the invention, a method of securing an object comprises fixing a band containing plural mutually insulated conductors to an object to be protected, in the event any of plural first predetermined numbers of opposite ends of the conductors are short circuited together via the conductors or by external means, making a determination that the band is intact and not raising an alarm, and in the opposite ends of only a second predetermined number of pairs of conductors, or in the event no opposite ends of any conductors are short circuited together by conductor or by external means, making a determination that the band has been tampered with, and raise an alarm.

In a preferred form of the invention, the second predetermined number is equal to one.

In accordance with another embodiment, a security tag comprises a strap for securing the tag to an object to be protected and an electronic module connected to the strap for detecting an attempt to defeat the tag by short circuiting and severing the strap, the strap being formed of plural discrete conductors connected via terminals to the electronic module which conductors are insulated from each other along at least a substantial length of the strap, the module containing a circuit for: in the event any of at least a predetermined number of plural opposite terminals to which the conductors are to be connected are short circuited together, making a determination that the band is intact and do not raise the alarm; in the event only one pair or a small number of pairs of opposite terminals, or no opposite terminals, to which one or more conductors would be connected are short circuited together, making a determination of the band as having been tampered with, and raise an alarm.

In accordance with another embodiment, a security tag comprises a strap for securing the tag to an object to be protected and an electronic module connected to the strap for detecting an attempt to defeat the tag by short circuiting and severing the strap, the strap being formed of plural discrete conductors connected to the electronic module which conductors are insulated from each other along at least a substantial length of the strap, wherein short circuiting opposite ends of a single pair of the conductors followed by severance of plural ones of the insulated conductors, or short circuiting between various separate insulated conductors, can be detected by the electronic module as an alarm condition, and wherein only severance or misconnection of only one or a small number of the insulated conductors is detected by the electronic module as not being an alarm condition.

In accordance with another embodiment, a connector for a security tag having a multiconductor band, comprises a slot in an insulating body having dimensions slightly larger than the cross-section of the band such as to guide insertion of the band into the slot, and conductive resilient mutually insulated contacts pointed toward a rear end of the slot supported by the insulating body for piercing insulation surrounding said majority of conductors upon the strap once having been inserted into the slot and past the contacts is pulled back outwardly relative to the slot, thereby making contact with said majority of conductors and at the same time inhibiting the strap from being able to be pulled back out from the slot.

In accordance with another embodiment, apparatus for securing an object comprises a multiconductor security strap connected to a strap tamper detector, wherein the conductors are mutually insulated over at least a major length of the strap, the strap being connected to the detector by at least one connector, the connector being comprised of a slot having dimensions slightly larger than the cross-section of the band such as to guide insertion of the band into the slot, and conductive resilient contacts pointed toward a rear end of the slot, for piercing insulation surrounding said majority of conductors upon the strap once having been inserted into the slot and past the contacts is pulled outwardly relative to the slot, thereby making contact with said majority of conductors and at the same time inhibiting the strap from be able to be pulled back out from the slot. The physical presence of a barrier at the end of the slot can prevent the strap from being pulled forward.

Another embodiment of the invention is an improvement in security of attachment of the device to a tapered part of the body (or structure), which reduces the chances of the device falling off or being kicked off a body part such as a baby's leg. In accordance with this embodiment, the strap attachment points to the module are offset from a center of the module wherein an axis of the strap is offset toward one edge of the module. The edge of the module can thus be located over the narrowest part of the baby's leg, and the strap can be the shortest possible length, reducing the possibility of it being able to be slipped off the baby's leg.

It is preferred that the major length of the strap is its full length.

BRIEF DESCRIPTION OF THE DRAWINGS

A better understanding of the invention will be obtained by a consideration of the detailed description below, in conjunction with the following drawings, in which:

FIG. 4 is a cross-sectional view of a preferred embodiment of a strap for use in a tag, FIG. 5 is a schematic diagram of the connector, FIG. 6 is a cross-sectional view of a preferred form of a connector, FIGS. 7A, 7B and 7C are cross-sectional views of a form of the connector in three stages of connection to the band, prior to insertion of the band, during insertion of the band, and making contact to the conductors of the band.

DETAILED DESCRIPTION OF EMBODIMENTS OF THE INVENTION

Figure 1:
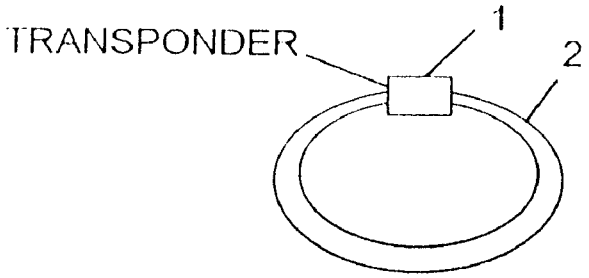
FIG. 1 is a schematic mechanical illustration of a tag in accordance with an embodiment of the invention.

Turning to FIG. 1, a transponder is shown as an electronic module 1. A strap 2, which contains plural conductors connected to the transponder, is wrapped around an object such as the wrist or ankle of a person, an asset, or a protrusion of an asset. As noted earlier, the transponder sends out signals periodically or on an exception basis (i.e. when a change is detected) which identify the transponder (and thus the associated asset or person) and optionally a location if the transponder has picked up the location from a peripheral transmitter, and the receiver which has picked up the signal transmitted by the transponder can provide location information of the transponder to a central computer.

If the strap is tampered with, such as by cutting, or by cutting after an attempt to short circuit the strap, or by short circuiting between separate conductors the transponder should detect the tampering and transmit an alarm. In accordance with an embodiment of the invention, the strap is multi-conductor, each conductor being insulated from the next over a substantial length, preferably over its entire length.

Figure 2:
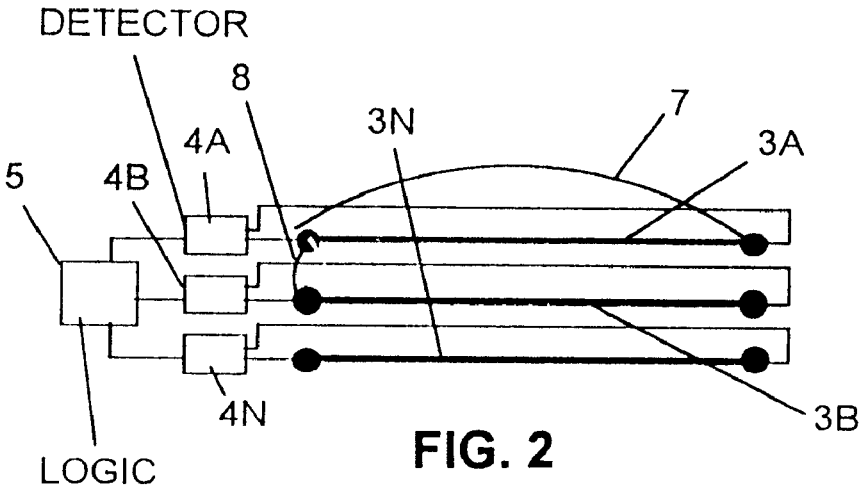
FIG. 2 is a schematic diagram of a circuit formed in accordance with an embodiment of the invention.

FIG. 2 illustrates a structure which can detect tampering, but which has the safeguard that more than one conductor must be severed before an alarm is raised. Further, more than one pair of conductors must be short circuited together in order to defeat the system.

The conductors in the strap are 3A, 3B . . . 3N. The conductors are coupled to short circuit, open circuit and resistance detectors 4A, 4B . . . 4N. Detectors 4A–4N are coupled to logic 5. Both ends of each of the conductors are connected to detectors 4A–4N. Alternatively, one or more conductors may be deliberately left disconnected and an alarm raised if a connection is detected.

In operation, a small current is passed from the detectors 4A–4N through the corresponding conductors 3A–3N. If one of the conductors 3A–3N is severed, this will be detected by the one of the detectors 4A–4N which is connected to the severed conductor, since current flow through that conductor will cease. However, since current will continue to flow through the other conductors, the logic 5 can determine using a state machine that only one of the detectors 4A–4N has detected a severed conductor. Since this can occur due to either a wire break caused by wear flexing or due to a corroded termination, no alarm is raised by logic 5.

However, if more than one conductor has been severed, this is more likely due to a purposeful attempt to damage the band. In such case, more than one detector 4A–4N will detect the cessation of the flow of current through the conductor connected to it, and the logic 5 in determining this state should raise the alarm.

It is possible that an attempt may be made to short circuit the ends of a conductor in order to maintain current flow through the conductor. Such a short circuit is shown by wire 7. In the event the ends of one conductor e.g. 3A is short circuited, or the end of one conductor is connected to the other end of another, and then more than one other conductor 3B–3N is cut, the detectors coupled to those other conductors will detect cessation of current, and logic 5 will raise an alarm as described above.

Since the presence of the strap connected to the detectors 4A–4N constitutes short circuits between the respective opposite terminals, the logic 5 should be implemented in either hard logic or by a microprocessor, to satisfy the process: in the event any of plural opposite terminals to which the conductors are to be connected are short circuited together, make a determination that the band is intact and do not raise the alarm; in the event only one pair of opposite terminals, or no opposite terminals, to which one or more conductors would be connected are short circuited together, make a determination that the band as having been tampered with, and raise an alarm.

It will be noted that during manufacture, if a connection of one conductor or a small number of conductors of the band are not properly made to a connector terminal and forms at least one open circuit, that will not cause an alarm to be raised since there will still be plural pairs of short circuits still in existence through plural remaining conductors of the band. The manufacturing tolerance in respect of connection of the band to the transponder circuitry, or the reliability of the connector or connectors of the band to the transponder circuitry, can thus be significantly relaxed, decreasing the cost of the assembly.

It should be noted that the process usefully should be able to consider that the band has been tampered with, with any predetermined plural minimum number of conductors short circuited, for example 2, 3, etc, rather than only one. Also, the process usefully should be able to consider that the band has not been tampered with, with any predetermined plural number of conductors remaining short circuited, for example 3, 4, etc, rather than only two.

In addition, or alternatively, in the event adjacent ends of more than one wire are short circuited together as shown by wire 8, and then those and at least one other conductor are cut, consider that the band has been tampered with, and raise an alarm. The cessation of current in this case would be detected by more than one detector 4A–4N, and an alarm raised by logic 5.

The conductors 3A–3N can each have a predetermined amount of resistance, and detection of a reduction in the resistance caused by provision of a short circuit wire 7 by the corresponding detector, and the cessation of current in plural other conductors can cause an alarm to be raised by logic 5.

FIG. 2 is an embodiment in which both ends of each of the conductors are connected to a corresponding detector. However, instead one of the ends of each of the conductors can be connected together and to a single return wire which is connected in common to each of the detectors.

Figure 3:
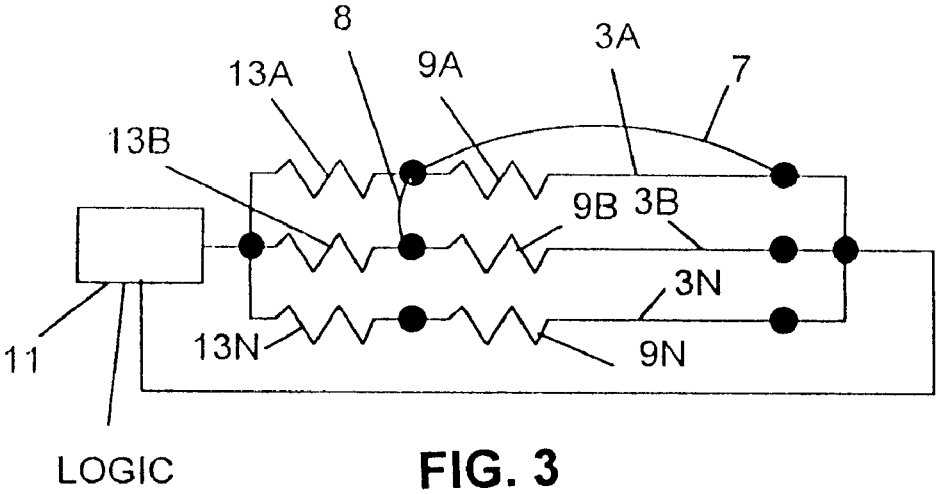
FIG. 3 is a schematic diagram of a circuit formed in accordance with another embodiment of the invention.

FIG. 3 illustrates the latter structure, but in this case each of the conductors contains resistance 9A–9N. In addition in another embodiment as shown in this Figure the other ends of the conductors are connected to each other. Therefore each of the mutually connected ends of the conductors is connected to a single detector/logic circuit 11 through respective internal resistors 13A–13N. The detector/logic circuit detects the change of resistance that occurs when ends of a pair of conductors are short circuited together via wire 8, or when the ends of a single conductor are short circuited together via a wire 7, and raises an alarm when the resistance is detected to change due to severing of more than one conductor, due to short circuiting of one conductor or of a pair of conductors together.

Alternatively or in addition, as noted earlier one or more conductors may deliberately be left disconnected and if connection is detected, as may occur if tampering is in process, the logic can determine this state and raise an alarm.

It is unlikely for a prospective tampering person to know which of plural conductors should be short circuited together in order to defeat the alarm system, or what resistance is necessary in a defeating short circuit, or which conductors should be left disconnected. However, the manufacturer will know, and can use a multiconductor short circuit to defeat the alarm system during testing.

An embodiment of the band is shown in cross-section in FIG. 4. Plural separated flat conductors 17 are disposed in the same plane, and are coated with a flexible insulator 19 such as a plastic material. The insulator fills the space between the conductors and covers both sides, thus fixing them in space, insulated from each other.

The ends of the conductors 17 are connected to connector terminals 21, as shown in FIG. 5. It will be seen that five conductors are shown, but the connector has seven terminals. This invention allows a single conductor to be connected to more than one terminal, and/or a connector with more than the number of conductors to accommodate bands with various numbers of connector terminals which may be required for different applications, but will still not indicate an alarm due to some connector terminals not being connected to conductors, or one conductor being connected to more than one terminal, etc., due to the process described above. The structure can thus be formed using a standard number of connector terminals for a variety of bands, thus reducing cost.

The band can be connected permanently at one end to the transponder and have another end connectable to the transponder via a multiconductor connector, or both ends of the band can be connectable to the transponder via a pair of connectors. FIG. 6 illustrates a novel form of connector which can be used at both ends or at only one end of the band. Reference is also made to FIGS. 7A, 7B and 7C which illustrate operation of the connector.

The connector is formed of an insulating enclosure which forms a slot 25. The slot can be either open at both ends (as shown), or can be closed at a back end to limit the distance that the end of the band can be inserted. The size of the slot is sufficient to accommodate and guide the end of the strap.

A plurality of separate resilient barbs which are insulated from each other extend into the slot, in a backward pointed direction. Each of the barbs is connected to the transponder which is contained in the enclosure, i.e. preferably to the short circuit and open circuit detectors previously described.

As shown in FIG. 7A, the barbs are not in contact with the band, prior to insertion. As the band is pushed into the slot 25, it bends the barbs toward one side of the slot, sliding past the barbs, as shown in FIG. 7B. Once inserted, the band is pulled back outwardly. The barbs pierce the insulation 19, and as the band is pulled against the barb, the barbs are pushed into the conductors of the band, both making connection to the correspondingly located conductors and acting to lock the band in the slot, as shown in FIG. 7C. The band is thereby connected to the transponder.

In the event a person tampers with the band by attempting to pull the band out of the slot, this acts to both seat the band more securely in the slot and causes the barbs to make better contact with the conductors. Tampering with the connector is this way is thus self-defeating.

A variation of the above constitutes a preferred embodiment. In this case, the contacts are not barbs, but are resilient hard conductive contacts. Instead of the conductors being imbedded in an insulator as in FIG. 4, they are printed on a flexible insulating base such as Mylar™. The conductors are covered with a thin insulating layer such as lacquer or vinyl which can be penetrated by abrasion.

In this case the end of the band is pushed into the slot with the insulating layer facing the contacts. The contacts abrade or otherwise penetrate the insulating layer over the conductors as the band passes the contacts. After insertion, the band is pulled outwardly. The friction against the contacts causes them to substantially fully abrade the insulating layer under them and also forces the contacts against the band, causing the contacts to make good contact with the conductors. A difference between this embodiment and the one previously described is that the contacts in this embodiment do not pierce the conductors.

It is also intended that in a further embodiment, the conductors can be printed on a substrate, and be pierced using the barb form of contacts.

In either case, the band is trapped in the slot by the contacts. In order to release the band, it can be cut, and pushed out the rear of the slot in the inserting direction. The connector is then ready to receive and make contact with a new band.

It will be recognized that the transponder module and strap are very usefully attached to persons, such as Alzheimer's patients, mental patients, prisoners, and newborn or older babies. On attachment to patients or prisoners, a system with which the transponders communicate can detect whether they have wandered off, and the strap attachment to a transponder module described herein will substantially foil their tampering in an attempt to remove it. Similarly, attachment to babies can detect attempts at abduction, and the strap described herein will also substantially foil tampering by an abductor attempting to remove it.

Previously designed modules used for similar purpose have been either boxy, cubic, round or disk shaped, with the axis of the strap passing through the center of the module so as to exert tension through the center of the module, similar to a wrist watch. However, we have found that this can allow the device to be slipped off the foot of a baby. The reason that the device can be slipped off is that a baby's leg is typically very tapered, and to accommodate the portion of the module which is to either side of the axis of the strap, the center of the module cannot be located at the narrowest diameter of the baby's leg. Accordingly, the length of the strap must be greater than the periphery of the baby's leg at its narrowest part. This has resulted in the excessively long strap length to allow the device to be slipped off if the edge of the module compresses the foot of the baby.

In accordance with an embodiment of the invention, the shape of the module has one edge with a very large radius. Indeed, the radius can be as large as infinity if desired (making the edge substantially linear). The strap is attached to the module so that one of its edges extends from a location near or at the large radius edge of the module. The connector or connectors described above is/are therefore located next to the large radius edge of the module. One surface of the module which is next to the leg of the baby is preferably planar or slightly concave to accommodate the curvature of the baby's leg.

Figure 8:
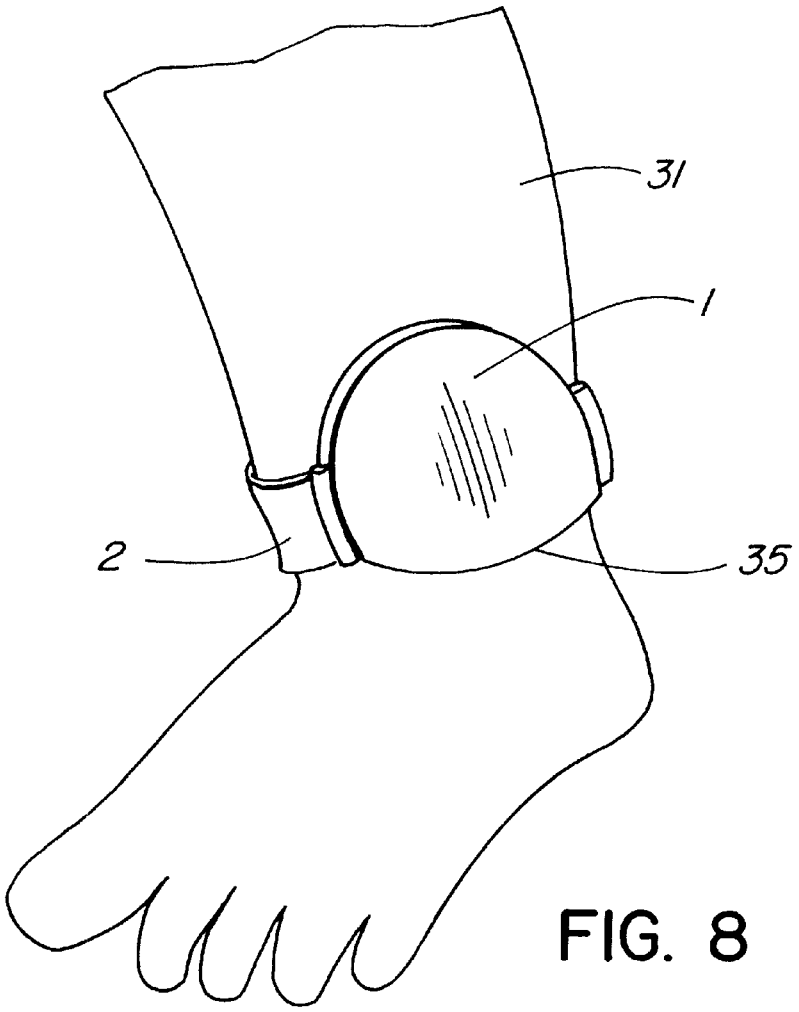
FIG. 8 is a perspective of the bottom of a baby's leg showing attachment of an embodiment of the security tag.

A perspective view of the module 1 attached to a baby's leg in accordance with this embodiment is shown in FIG. 8. As may be seen, the large radius edge 35 of the module is disposed next to the foot of the baby. Since the strap extends around the narrowest part of the tapered leg of the baby, its circumference is smaller than straps of the prior art, and this will greatly reduce the chances of the device falling or being kicked off the baby.

Figure 9:
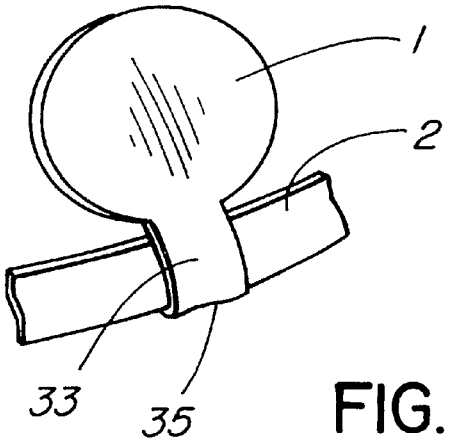
FIG. 9 is another embodiment of the security tag shown in FIG. 8.

Another embodiment is shown in FIG. 9, in which the module 1 has an extension 33 to which the strap is connected or otherwise attached. The large radius edge 35 is at the bottom of the extension. The extension 33 can have the same, or a different thickness than the remainder of the module.

The latter two embodiments preferably use the multiconductor form of strap and/or connector described earlier, or they it can be used independently on modules using straps as in the prior art.

A person understanding this invention may now conceive of alternate embodiments and enhancements using the principles described herein. All such embodiments and enhancements are considered to be within the spirit and scope of this invention as defined in the claims appended hereto.

We claim:

1. A security tag comprising a strap for securing the tag to an object to be protected and an electronic module connected to the strap for detecting an attempt to defeat the tag by short circuiting and severing the strap, the strap being formed of plural discrete conductors connected to the electronic module, which conductors are insulated from each other along at least a substantial length of the strap, wherein short circuiting of opposite ends of a single one of the conductors followed by severance of plural ones of the insulated conductors, or short circuiting between various separate insulated conductors can be detected by the electronic module as an alarm condition, and wherein severance or misconnection of only one or a small number of the insulated conductors is detected by the electronic module as not being an alarm condition.

2. A security tag as defined in claim 1, in which strap attachment points to the module are offset from a center of the module, wherein an axis of the strap is offset toward one edge of the module.

3. A security tag as defined in claim 1, in which the electronic module has a shape which includes a substantially plane or slightly concave surface one edge of which has a large radius which extends between substantially opposite sides of said surface, the module having attachment apparatus for the strap at locations adjacent opposite ends of said large radius edge.

4. A security tag comprising a strap for securing the tag to an object to be protected and an electronic module connected to the strap for detecting an attempt to defeat the tag by short circuiting and severing the strap, the strap being formed of plural discrete conductors connected via terminals to the electronic module, which conductors are insulated from each other along at least a substantial length of the strap, the module containing a circuit for: in the event any of at least a predetermined number of plural opposite terminals to which the conductors are to be connected are short circuited together, making a determination that the band is intact and do not raise the alarm; in the event only one pair or a small number of opposite terminals, or no opposite terminals, to which one or more conductors would be connected are short circuited together, making a determination that the band has been tampered with, and raising an alarm.

5. A security tag as defined in claim 4 in which each of the conductors has a predetermined resistance.

6. A security tag as defined in claim 4 including at least one multiconductor connector containing the terminals fixed to the electronic module for making contact with at least a majority of conductors once an end of the strap has been inserted into the connector.

7. A security tag as defined in claim 6 in which the connector is comprised of a slot having dimensions slightly larger than the cross-section of the band such as to guide insertion of the band into the slot, and conductive resilient contacts pointed toward a rear end of the slot, for piercing insulation surrounding said majority of conductors when the strap, once having been inserted into the slot and past the contacts, is pulled back outwardly relative to the slot, thereby making contact with said majority of conductors and at the same time inhibiting the strap from being able to be pulled out from an insertion end of the slot.

8. A security tag as defined in claim 7 including a pair of similar multiconductor connectors fixed to the electronic module, each for making contact with conductors of the tag adjacent opposite ends of the strap.

9. A connector for a security tag having a multiconductor band, comprising a slot in an insulating body having dimensions slightly larger than the cross-section of the band such as to guide insertion of the band into the slot, and conductive resilient mutually insulated contacts pointed toward a rear end of the slot supported by the insulating body for piercing insulation surrounding said majority of conductors when the strap, once having been inserted into the slot and past the contacts, is pulled back outwardly relative to the slot, thereby making contact with said majority of conductors and at the same time inhibiting the strap from be able to be pulled back out from the slot.

10. Apparatus as defined in claim 9 in which the resilient contacts are barbs for piercing both the insulation and the conductors.

11. Apparatus for securing an object comprising a multi-conductor security strap connected to a strap tamper detector, wherein the conductors are mutually insulated over at least a major length of the strap, the strap being connected to the detector by at least one connector, the connector being comprised of a slot having dimensions slightly larger than the cross-section of the band such as to guide insertion of the band into the slot, and conductive resilient contacts pointed toward a rear end of the slot, for piercing insulation surrounding said majority of conductors upon the strap once having been inserted into the slot and past the contacts is pulled outwardly relative to the slot, thereby making contact with said majority of conductors and at the same time inhibiting the strap from be able to be pulled back out from the slot.

12. Apparatus as defined in claim 11 including a pair of similar connectors connected to the strap tamper detector for making contact with conductors of the tag adjacent opposite ends of the strap.

13. Apparatus as defined in claim 11 in which each of the conductors has a width which is a multiple of its thickness, the conductors being disposed substantially coplanar, parallel to each other and separated along a length of the strap, the conductors being separated by and covered with a flexible insulating material.

14. Apparatus as defined in claim 13, including a circuit connected to the at least one connector for: in the event any of at least a predetermined number of plural opposite ends of the conductors being short circuited together, making a determination that the band is intact and not raising an alarm; in the event only another predetermined number of pairs of terminals, to which one or more conductors would be connected being short circuited together, making a determination that the band has been tampered with, and raising an alarm.

15. Apparatus as defined in claim 13 in which the conductors are printed on a flexible insulating substrate.

16. Apparatus as defined in claim 11 in which the resilient contacts are barbs for piercing the conductors.

17. Apparatus as defined in claim 11 in which the conductors are printed on a flexible insulating substrate.

18. Apparatus as defined in claim 17 in which the resilient contacts are shaped so as to abrade and pass through a surface insulating layer of the band so as to make contact with a resulting exposed surface of the conductors.

19. A method of securing an object comprising fixing a band containing plural mutually insulated conductors to an object to be protected, in the event any of plural first predetermined numbers of opposite ends of the conductors are short circuited together via the conductors or by external means, making a determination that the band is intact and not raising an alarm, and in the event opposite ends of only a second predetermined number of pairs of conductors, or in the event no opposite ends of any conductors are short circuited together by said conductors or by external means, making a determination that the band has been tampered with, and raise an alarm.

20. A method as defined in claim 19, in which the second predetermined number is equal to one.

21. A security tag comprised of a module to which a strap is to be connected, and strap attachment points to the module offset from a center of the module wherein an axis of the strap is offset toward one edge of the module.

22. A security tag as defined in claim 21, in which the strap attachment points are located so as to position one edge of the strap along a line extending from approximately an edge of the module.

23. A security tag as defined in claim 21, including a strap having at least one elongated conductor embedded therein connected via the attachment points to a tamper detector within the module.

24. A security tag as defined in claim 23, including an electrical connector coupled to the tamper detector located at at least one attachment point.

25. A security tag as defined in claim 21, in which the strap is formed of plural discrete conductors connected to the electronic module which conductors are insulated from each other along at least a substantial length of the strap, wherein short circuiting of opposite ends of a single pair of the conductors followed by severance of plural ones of the insulated conductors, or short circuiting between various separate insulated conductors can be detected by the electronic module as an alarm condition, and wherein severance or misconnection of one or a small number of the insulated conductors is detected by the electronic module as not being an alarm condition.

26. A security tag as defined in claim 21, in which the shape of the electronic module has one edge of a substantially plane or slightly concave surface which has a large radius which extends between substantially opposite sides of said surface, the module having attachment points for the strap at locations adjacent opposite ends of said large radius edge.

27. A security tag as defined in claim 21 in which the strap attachment points are located on opposite sides of an extension of a module which extension has substantially smaller lateral dimension than the lateral width of the remainder of the module.

28. A security tag comprised of a module to which a strap is to be connected, the shape of the electronic module having one edge to a substantially plane or slightly concave surface which has a large radius which extends between substantially opposite sides of said surface, the module having attachment points for the strap at locations adjacent opposite ends of said large radius edge.

29. A security tag as defined in claim 28, in which the strap is formed of plural discrete conductors connected to the electronic module which conductors are insulated from each other along at least a substantial length of the strap, wherein short circuiting of opposite ends of a single pair of the conductors followed by severance of plural ones of the insulated conductors, or short circuiting between various separate insulated conductors can be detected by the electronic module as an alarm condition, and wherein severance or misconnection of one or a small number of the insulated conductors is detected by the electronic module as not being an alarm condition.

* * * * *